US005961315A

United States Patent [19]

Haumann et al.

[11] Patent Number: 5,961,315

[45] Date of Patent: Oct. 5, 1999

[54] BOILER PLANT FOR HEAT GENERATION

[75] Inventors: Jürgen Haumann, Rekingen; Hans Peter Knöpfel, Besenbüren, both of Switzerland; Thomas Sattelmayer, Erding, Germany

[73] Assignee: ABB Research Ltd., Zurich, Switzerland

[21] Appl. No.: 09/032,840

[22] Filed: Mar. 2, 1998

[30] Foreign Application Priority Data

Mar. 18, 1997 [EP] European Pat. Off. ..... 97810161

[51] Int. Cl.[6] ..... F23M 9/06

[52] U.S. Cl. ..... 431/115; 431/171

[58] Field of Search ..... 431/171, 172, 431/115, 116

[56] References Cited

U.S. PATENT DOCUMENTS

| | | | |
|---|---|---|---|
| 2,368,827 | 2/1945 | Hanson et al. | 431/171 |
| 2,628,674 | 2/1953 | Fore | 431/171 |
| 5,044,495 | 9/1991 | Peter | 431/115 |
| 5,405,261 | 4/1995 | Scraggs et al. | 431/171 |
| 5,423,674 | 6/1995 | Knopfel et al. | 431/115 |

FOREIGN PATENT DOCUMENTS

| | | |
|---|---|---|
| 0266857A2 | 5/1988 | European Pat. Off. . |
| 0436113A1 | 7/1991 | European Pat. Off. . |
| 0629817A2 | 12/1994 | European Pat. Off. . |
| 0740108A2 | 10/1996 | European Pat. Off. . |
| 1905006 | 9/1970 | Germany . |
| WO92/06328 | 4/1992 | WIPO . |

*Primary Examiner*—Carroll Dority

*Attorney, Agent, or Firm*—Burns, Doane, Swecker & Mathis, L.L.P.

[57] ABSTRACT

In a boiler plant for heat generation, which consists essentially of a combustion space and of a burner acting on the head side of the combustion space, this combustion space is divided into two parts (17,102*a*) by the insertion of an annular disk (103). A limited internal backflow zone (24) forms in the front part (17) in interaction with this disk (103). This disk (103) then causes external backflow zones (106) fed by recirculated flue gases (30) to form within the front part (17) of the combustion space, the flue gases of said external backflow zones being introduced into the combustion process of the burner, said backflow zones (24, 106) being in each case separated locally from one another. Better flame stabilization, lower pulsations and markedly lower pollutant emissions can thereby be achieved when the burner is operating.

11 Claims, 5 Drawing Sheets

1
2
5
6
7
13
14
27
28
29
30
31
31a
32
32a
200

26
31
31a
32
32a
33

BOILER PLANT FOR HEAT GENERATION

BACKGROUND OF THE INVENTION

1. Field of the Invention

The invention relates to a boiler plant for heat generation.

2. Discussion of Background

The flame stabilization of many modern low-NOx burners is based on the generation of a backflow bubble or backflow zone (=vortex breakdown). If the swirl generator has an unfavorable design, too high a swirl rate causes the desired short backflow bubble to change into a long almost cylindrical backflow zone due to the breakdown of the vortex. When the burner operates without a combustion chamber or with too large a combustion space or with relatively cold combustion chamber walls of a boiler, heat is taken away from the flue gases flowing back in the core. This leads, particularly during startup, to insufficient flame stabilization and, when liquid fuels are used for operation, to inadequate preevaporation of the fuel drops. This behavior may be observed even in the case of burners with passive flue gas recirculation in the combustion space. These problems may lead to flame breakaway or oscillations and make an undesirable special startup procedure necessary. Moreover, as regards heating furnaces, it is necessary to have a very long startup phase with increased emissions, in which the entire boiler, with its relatively high thermal inertia, has to be heated up until the flue gases flowing back are at a sufficient temperature.

SUMMARY OF THE INVENTION

The invention is intended to remedy this. The object on which the invention, is based is, in a boiler plant of the type initially mentioned, to propose measures which prevent excessive cooling of the reacted gases, that is to say of the recirculated flue gases.

This is achieved by placing within the combustion space a diaphragm or corresponding means subdividing the combustion space. It must be stressed, in this case, that the design of this diaphragm may be diverse and, for example, is not restricted to an annular disk. Other means which are capable of triggering the effects described below are likewise an integral part of the subject of this invention.

As a result of the measure according to the invention, therefore, the combustion space is subdivided into two parts, particularly the front part of the combustion space being relevant as to effect.

As regards the abovementioned front part of the combustion space, the measure according to the invention achieves the effect that an internal backflow zone and external backflow zones may in each case arise so as to be locally defined in relation to one another, thus resulting in a clear separation of the two.

The essential advantage of the invention is to be seen in that the flow is accelerated in the center of the combustion space, thus leading to a shortening of the internal backflow zone, that is to say this internal backflow zone is limited downstream. The result of this is that hotter flue gases now occur on the burner axis and excessive cooling of the reacted gases forming there is thus prevented. These gases, which now have a higher temperature level, then flow as recirculated flue gases, via the separately acting external backflow zones locally defined in relation to the internal backflow zone, to an injector system which belongs to the burner.

The two effects bring about better flame stabilization and fuel evaporation. This leads, in turn, to markedly lower pulsations during the startup operation and also to markedly lower pollutant emissions in this transient phase.

Exemplary embodiments of the invention are explained in more detail below with reference to the drawings. All elements not necessary for the direct understanding of the invention have been omitted. Identical elements are provided with the same reference symbols in the various figures. The direction of flow of the media is indicated by arrows.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
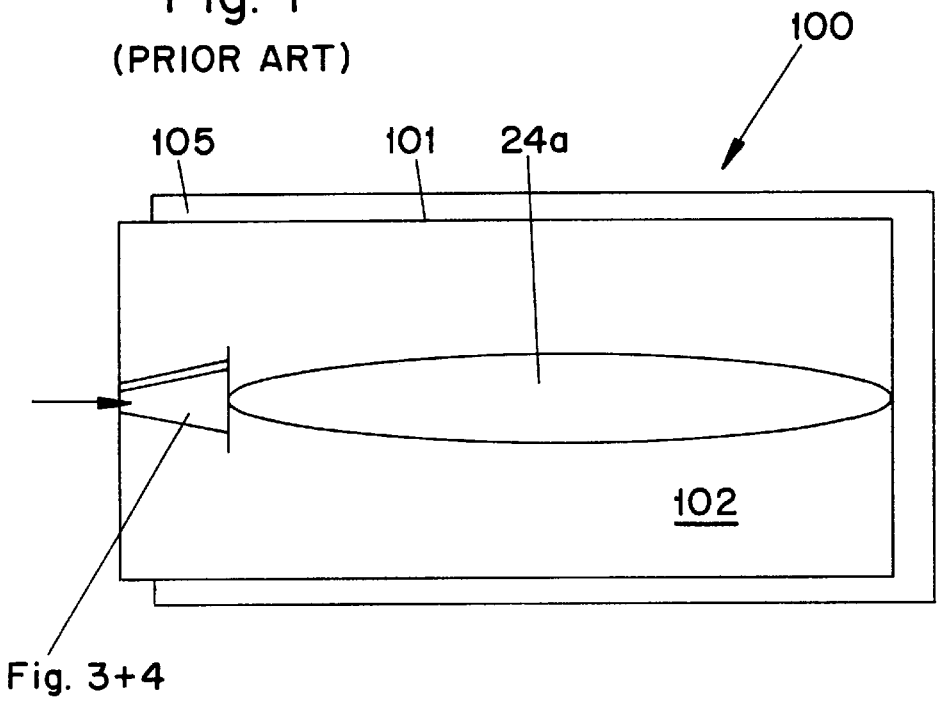
Fig. 1 (PRIOR ART)
FIG. 1 shows a prior art boiler plant which is operated with a premixing burner, with a device for limiting the extent of the backflow zone.

Referring now to the drawings, wherein like reference numerals designate identical or corresponding parts throughout the several views, FIG. 1 shows a boiler plant 100 belonging to the prior art, such as is conventionally used for heating furnaces. This boiler plant 100 consists essentially of a combustion space 102 which is formed from a flame tube 101 and which is surrounded by a heat resistant bulkhead 105. The boiler plant is operated, here, by means of a premixing burner, the description of which emerges in more detail with reference to FIGS. 3 and 4. However, this boiler plant does not have to be operated solely by means of this burner; other types of burner, in each case with flame stabilization, may also be employed. FIG. 1 is intended primarily to show the initially mentioned almost cylindrical elongate backflow zone 24*a* leading to the disadvantages which were initially mentioned and which are eliminated by the proposal according to FIG. 2.

Figure 2:
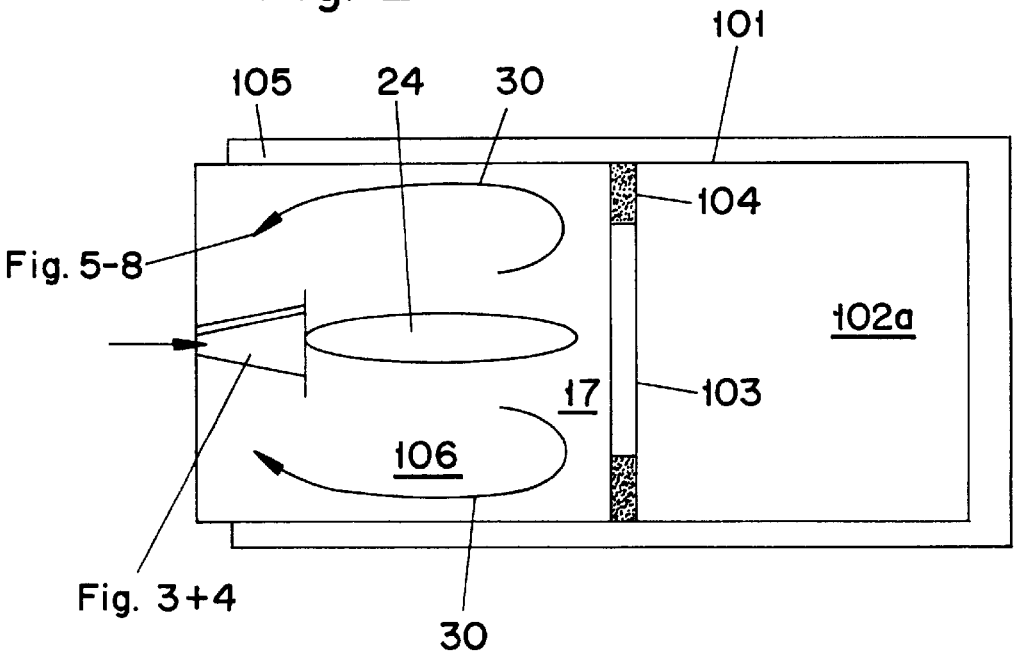
FIG. 2 shows a an embodiment of the device in accordance with the present invention for limiting the extent of the backflow zone.

FIG. 2 shows the subdivision of the combustion space by means of an annular disk 103 which acts as a diaphragm and the steps 104 of which bring about a limitation of the internal backflow zone 24. This internal backflow zone 24 is thus limited in the direction of flow within the front part 17 of the combustion space, thereby preventing excessive cooling of the reacted gases. The second part 102*a* of the combustion space, downstream of the diaphragm 103, serves as a waste gas zone. The flow itself is accelerated within the first part 17 of the combustion space in the center of the combustion space, and this then leads to a compact and shortened internal backflow zone 24, as emerges very clearly from FIG. 2. Since hotter flue gases are conducted towards the burner on the burner axis, better flame stabilization is achieved. Moreover, external backflow zones 106 of reacted gases occur as a result of the subdivision of the combustion space carried out by means of the annular disk 103, said gases being introduced as recirculated flue gases via injectors (see, in this respect, FIGS. 5 to 8) into the combustion process of the premixing burner (see FIGS. 3 and 4) taken as a basis here. Since these flue gases 30 experience minimized cooling on account of the limitation predetermined by the annular disk 103, increased fuel evaporation can be achieved as a result of the higher temperature level of these flue gases 30, said evaporation leading to better flame stabilization and to markedly lower pollutant emissions. The internal backflow zone 24 and the external backflow zones 106 are in each case separated from one another in a locally defined manner. The distance of this annular disk 103 and the means used in each case for this purpose from the front wall of the burner depends on the respective operating conditions. The same also applies to the degree of stepping 104 of the annular disk 103, that is to say the degree of cross sectional reduction triggered by such means or the degree of reduction in the flow passage. The simplicity of the means proposed here, particularly as regards the annular disk, readily allows appropriate adaptions to be made.

Figure 3:
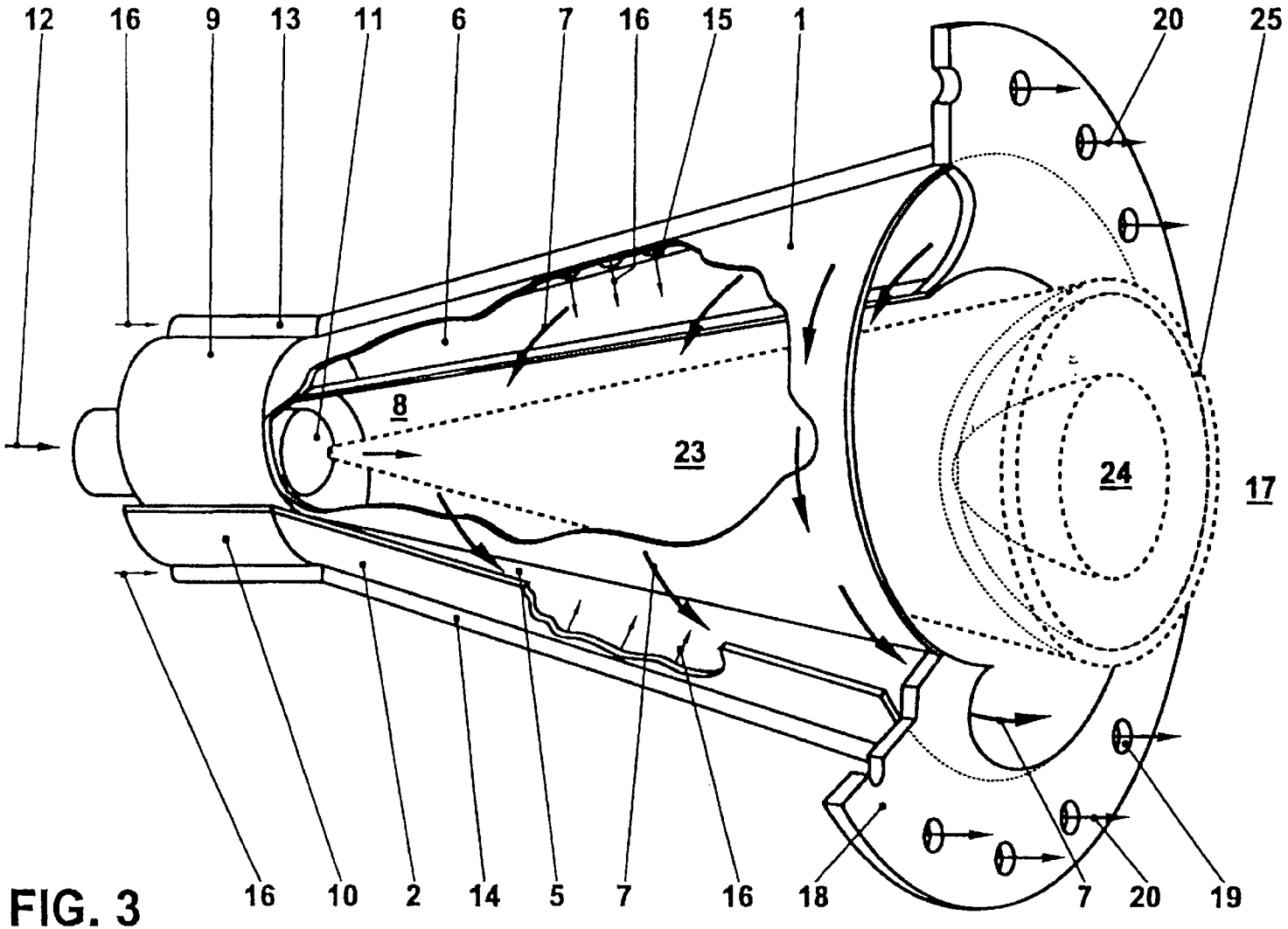
FIG. 3 shows a perspective illustration of a premixing burner for operating the boiler plant.
Figure 4:
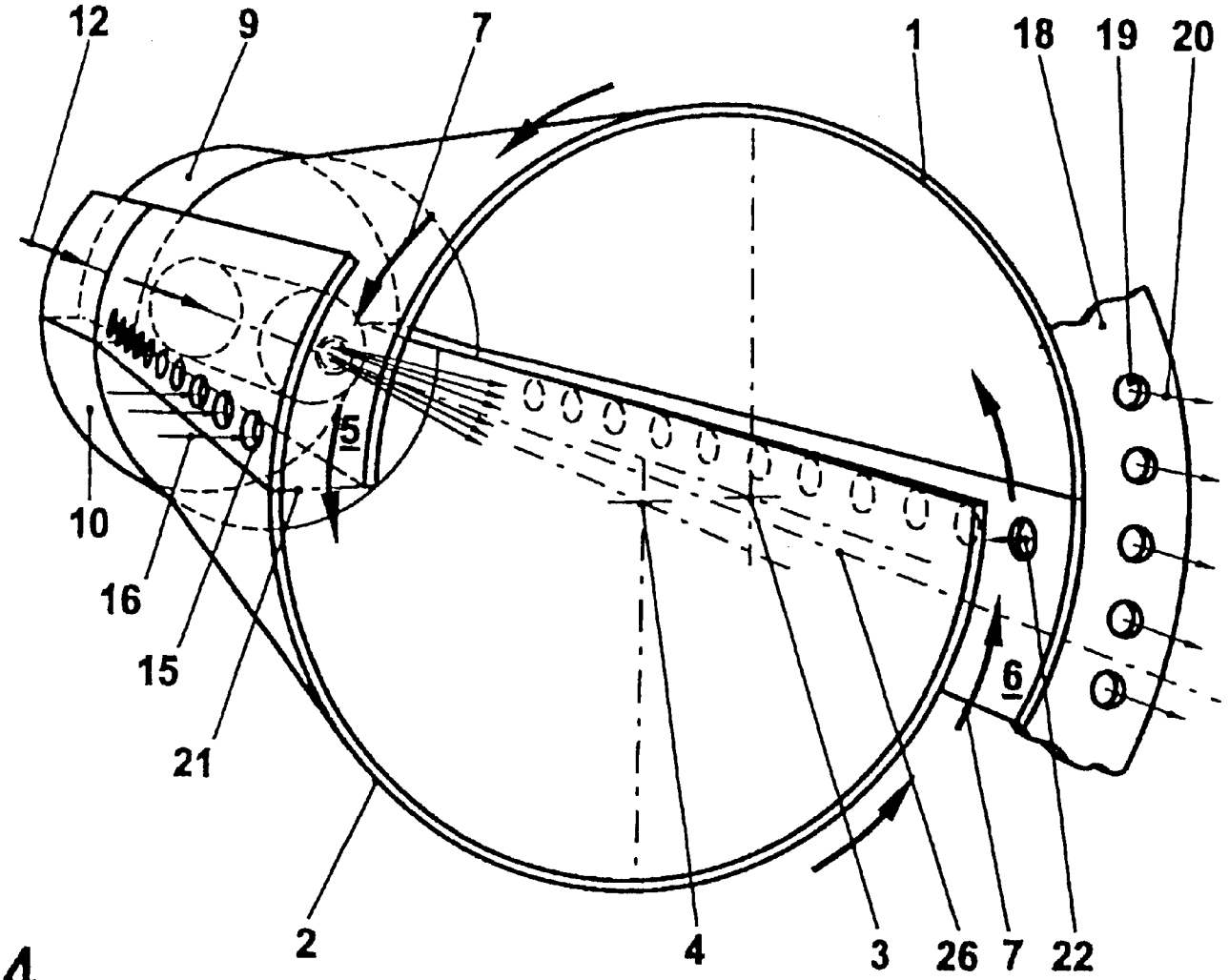
FIG. 4 shows a further perspective illustration of this premixing burner from another view in simplified form.

FIG. 3 shows a perspective illustration of a premixing burner. To understand the subject better, it is advantageous if at least FIG. 4 is also referred to at the same time while FIG. 3 is being examined. The main purpose of these two Figures is to make clear the nature and functioning of such a burner.

The premixing burner according to FIG. 3 consists of two hollow conical part bodies 1, 2, which are nested one in the other so as to be offset to one another, and is operated with a gaseous and/or liquid fuel. The term "conical" not only refers here to the conical shape shown, characterized by a fixed aperture angle, but also includes other configurations of the part bodies, such as a diffuser or diffuser-like shape and a confuser or confuser-like shape. These shapes are not illustrated specially here, since the average person skilled in the art is immediately familiar with them. The offset of the respective center axis or longitudinal axis of symmetry of the part bodies 1, 2 to one another (see FIG. 4, designations 3 and 4) leaves a tangential air inlet duct 5, 6 free on each of the two sides in a mirror symmetrical arrangement, through which ducts the combustion air 7 flows into the interior of the premixing burner, that is to say into the conical cavity 8. The two conical part bodies 1, 2 each have a cylindrical initial part 9, 10, said initial parts likewise being offset to one another in a similar way to the above-mentioned part bodies 1, 2, so that the tangential air inlet ducts 5, 6 are present over the entire length of the premixing burner. A nozzle 11 for the preferable atomization of a liquid fuel 12 is accomodated in the region of the cylindrical initial part, in such a way that the injection of said nozzle coincides approximately with the narrowest cross section of the conical cavity 8 formed by the part bodies 1, 2. The injection capacity and operating mode of this nozzle 11 depend on the predetermined parameters of the respective premixing burner. If required, the fuel 12 injected by the nozzle 11 may be enriched with a recirculated waste gas; it is then also possible to carry out the complementary injection of a quantity of water by means of the nozzle 11.

The premixing burner may, of course, be designed purely conically, that is to say without cylindrical initial parts 9, 10. Furthermore, the part bodies 1, 2 each have a fuel line 13, 14, said fuel lines being arranged along the tangential inlet ducts 5, 6 and being provided with injection ports 15, through which preferably a gaseous fuel 16 is injected into the combustion air 7 flowing past there, as is symbolized by arrows 16, this injection at the same time forming the fuel injection plane (see FIG. 4, designation 22) of the system. These fuel lines 13, 14 are preferably placed at the latest at the end of tangential inflow, prior to entry into the conical cavity 8, this being in order to ensure an optimum air/fuel mixture.

On the combustion space side, the premixing burner has a front plate 18 serving as anchoring for the part bodies 1, 2 and having a number of bores 19, through which mixing or cooling air 20 is supplied, as required, to the front part of the combustion space 17 or its wall.

If, as already described, the premixing burner is operated solely by means of a liquid fuel 12, this takes place via the central nozzle 11, this fuel 12 then being injected into the conical cavity 8 or into the combustion space 17 at an acute angle. A conical fuel profile 23 therefore forms out of the nozzle 11, said fuel profile being surrounded by the rotating combustion air 7 flowing in tangentially. The concentration of the injected fuel 12 is continuously reduced in the axial direction by the inflowing combustion air 7 so as to form an optimum mixture.

If the premixing burner is to be operated with a gaseous fuel 16, this may, in principle, also be carried out via the central fuel nozzle 11, but such an operating mode should preferably be performed via the injection ports 15, the formation of this fuel/air mixture taking place directly at the end of the air inlet ducts 5, 6.

During the injection of the liquid fuel 12 via the nozzle 11, the optimum homogeneous fuel concentration over the cross section is achieved at the end of the premixing burner. If the combustion air 7 is additionally preheated or enriched with a recirculated waste gas, this sustainedly assists evaporation of the liquid fuel 12 within the premixing stage induced by the length of the premixing burner. As regards the admixing of a recirculated flue gas, reference is made to FIGS. 5 to 8.

The same considerations also apply when liquid fuels are to be supplied via the fuel lines 13, 14 instead of gaseous fuels.

Narrow limits must per se be adhered to in the design of the conical part bodies 1, 2 with regard to the increase in the flow cross section and to the width of the tangential air inlet ducts 5, 6, so that the desired flow field of the combustion air 7 can be established at the exit of the premixing burner. The critical swirl rate is established at the exit of the premixing burner: a backflow zone 24 (vortex breakdown) also forms there, with a stabilizing effect in respect of the flame front 25 acting there, in the sense that the backflow zone 24 performs the function of a bodiless flame holder.

The optimum fuel concentration over the cross section is achieved only in the region of the vortex breakdown, that is to say in the region of the backflow zone 24. Only at this point does a stable flame front 25 then occur. The flame stabilizing effect is obtained in the direction of flow along the cone axis as a result of the swirl rate which forms in the conical cavity 8. A flashback of the flame into the interior of the premixing burner is thus prevented.

It must be said, in general, that minimizing the throughflow orifice of the tangential air inlet ducts 5, 6, is predestined to produce the backflow zone 24 from the end of the premixing stage. Furthermore, the design of the premixing burner is preeminently suitable for varying the throughflow orifice of the tangential air inlet ducts 5, 6, as required, as a result of which a relatively large operational band width can be covered without any variation in the overall length of the premixing burner. The part bodies 1, 2 can, of course, also be displaced relative to one another in another plane, with the result that it is even possible to cause overlapping in relation to the air inlet plane into the conical cavity 8 (see FIG. 4, designation 21) of said part bodies in the region of the tangential air inlet ducts 5, 6, as emerges from FIG. 4. It is then also possible for the part bodies 1, 2 to be nested spirally one in the other by means of an opposed rotational movement.

A more homogeneous mixture formation capable of being obtained in this premixing burner between the injected fuels 11, 12 and the combustion air 7 achieves lower flame temperatures and therefore lower pollutant emissions, in particular lower NOx values. These lower temperatures then reduce the thermal load on the material at the burner front and, for example, ensure that special treatment of the surface is not mandatory.

As regards the number of air inlet ducts, the premixing burner is not restricted to the number shown. A larger number is advisable, for example, where it is important to make premixing wider or correspondingly to influence the swirl rate and therefore the formation of the backflow zone 24, which depends on said swirl rate, by means of a larger number of air inlet ducts.

Premixing burners of the type described here are also those which start from a cylindrical or quasi-10 cylindrical tube for achieving a swirl flow and in which the inflow of combustion air into the interior of the tube is brought about via air inlet ducts likewise placed tangentially and inside the tube is arranged a conical body having a cross section decreasing in the direction of flow, as a result of which a critical swirl rate at the exit of the burner can be achieved with this configuration, too.

FIG. 4 shows the same premixing burner according to FIG. 3, but from another perspective and in a simplified illustration. This FIG. 4 is to serve essentially for grasping the configuration of this premixing burner perfectly. In particular, this FIG. 4 shows very clearly the offset of the two part bodies 1, 2 to one another in respect of the main center axis 26 (=burner axis) of the premixing burner, said axis corresponding to the main axis of the central fuel nozzle 11. This offset induces per se the size of the throughflow orifices of the tangential air inlet ducts 5, 6. The center axes 3, 4 run parallel to one another here.

Figure 5:
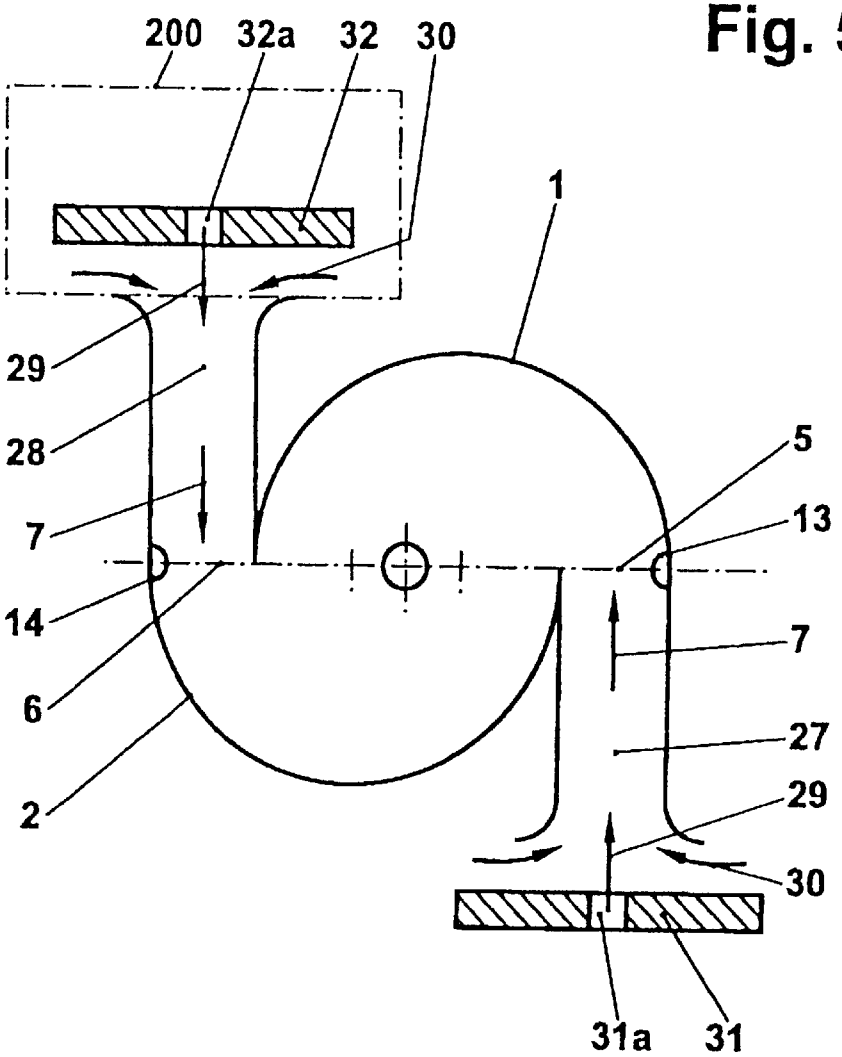
FIG. 5 shows a section through the premixing burner according to FIG. 2 or 3, equipped with injectors, the inflow plane of supply ducts running parallel to the burner axis.

FIG. 5 is a section approximately in the middle of the premixing burner. The supply ducts 27, 28 tangentially arranged mirror symmetrically perform the function of a mixing stage, in which the combustion air 7, formed from fresh air 29 and recirculated flue gas 30, is perfected. The combustion air 7 is conditioned in an injector system 200. Upstream of each supply duct 27, 28 which serves as a tangential inflow into the interior 8 of the premixing burner, the fresh air 29 is distributed uniformly over the entire length of the premixing burner via perforated plates 31, 32. These perforated plates are perforated in the direction of flow relative to the tangential inlet ducts 5, 6. The perforations perform the function of individual injector nozzles 31*a*, 32*a* which exert a suction effect in relation to the surrounding flue gas 30, such that each of these injector nozzles 31*a*, 32*a* in each case sucks in only a specific fraction of flue gas 30, whereupon a uniform admixing of flue gas takes place over the entire axial length of the perforated plates 31, 32 which corresponds to the burner length. This configuration ensures that intimate mixing takes place as early as at the point of contact of the two media, that is to say the fresh air 29 and the flue gas 30, so that the flow length of the supply ducts 27, 28 for mixture formation, said flow length reaching as far as the tangential air inlet slits 5, 6, can be minimized. In addition, the injector configuration 200 here is distinguished in that the geometry of the premixing burner, particularly as regards the shape and size of the tangential air inlet ducts 5, 6, remains dimensionally stable, that is to say no heat related distortions occur along the entire axial length of the premixing burner due to the uniformly metered distribution of the flue gases 30 which are hot per se. The same injector configuration as that just described here may also be provided in the region of the head-side fuel nozzle 11 for axial supply of combustion air.

Figure 6:
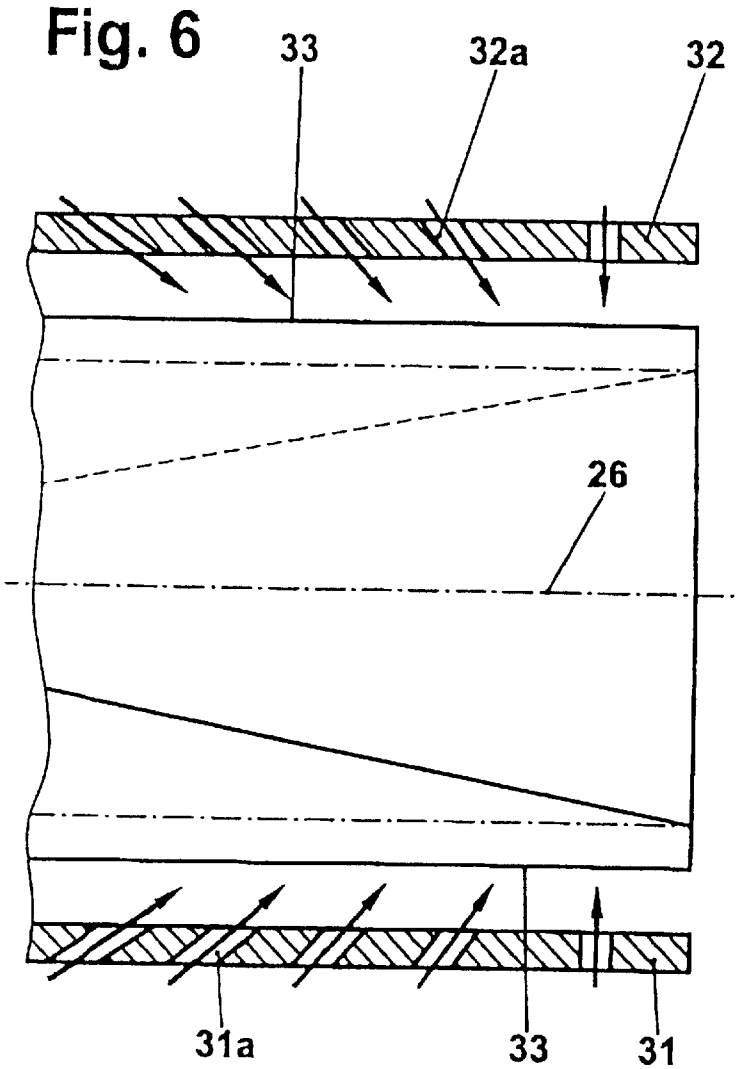
FIG. 6 shows a configuration of the injector system in the direction of flow.

FIG. 6 is a diagrammatic illustration of the premixing burner in the direction of flow, revealing, in particular, the run of the perforated plates 31, 32, belonging to the injector system, in relation to the inflow planes 33 of the supply ducts 27, 28. This run is parallel, the inflow planes 33 themselves running parallel to the burner axis 26 of the premixing burner over the entire burner length. It can also be seen in this figure how the injector nozzles 31*a*, 32*a* vary their inflow angle in relation to the burner axis 26 of the premixing burner. From an initial acute angle in the region of the head stage of the premixing burner, they gradually straighten up until they are approximately perpendicular to the burner axis 26 in the region of the exit. By virtue of this measure, the mixing quality of the combustion air is increased and the backflow zone is kept in a stable position. However, such an inclination is not indispensable in every burner. Right-angled inflows may also partially be used.

Figure 7:
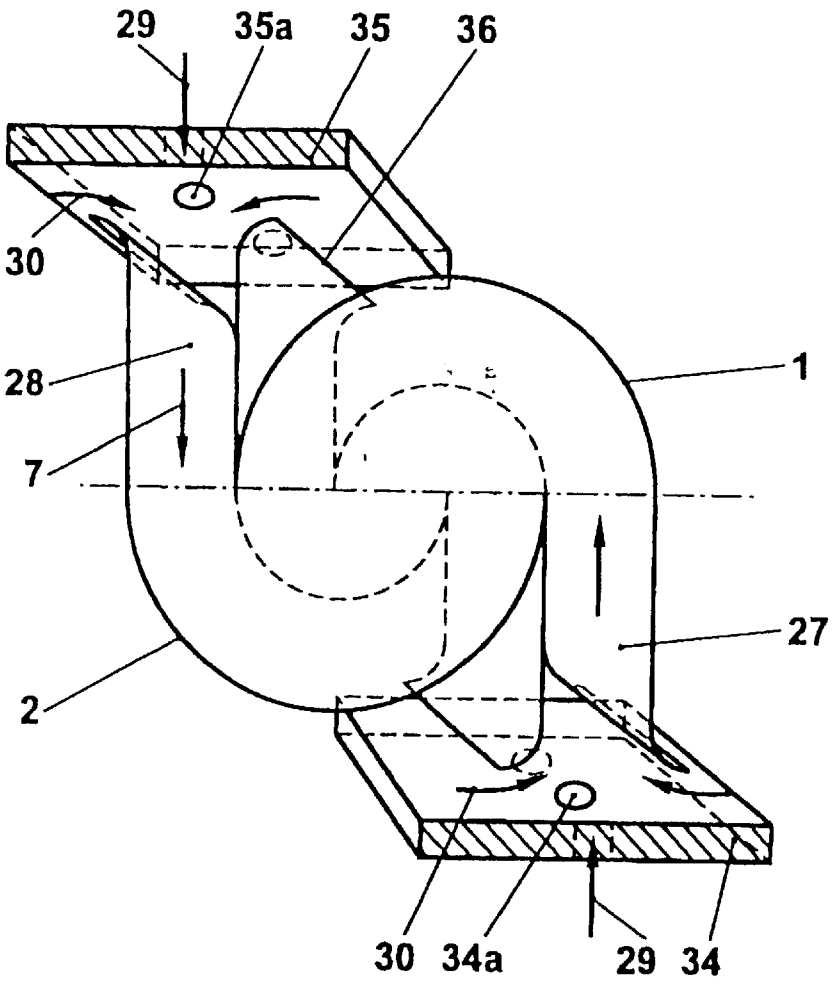
FIG. 7 shows a further embodiment of the inflow plane of supply ducts.
Figure 8:
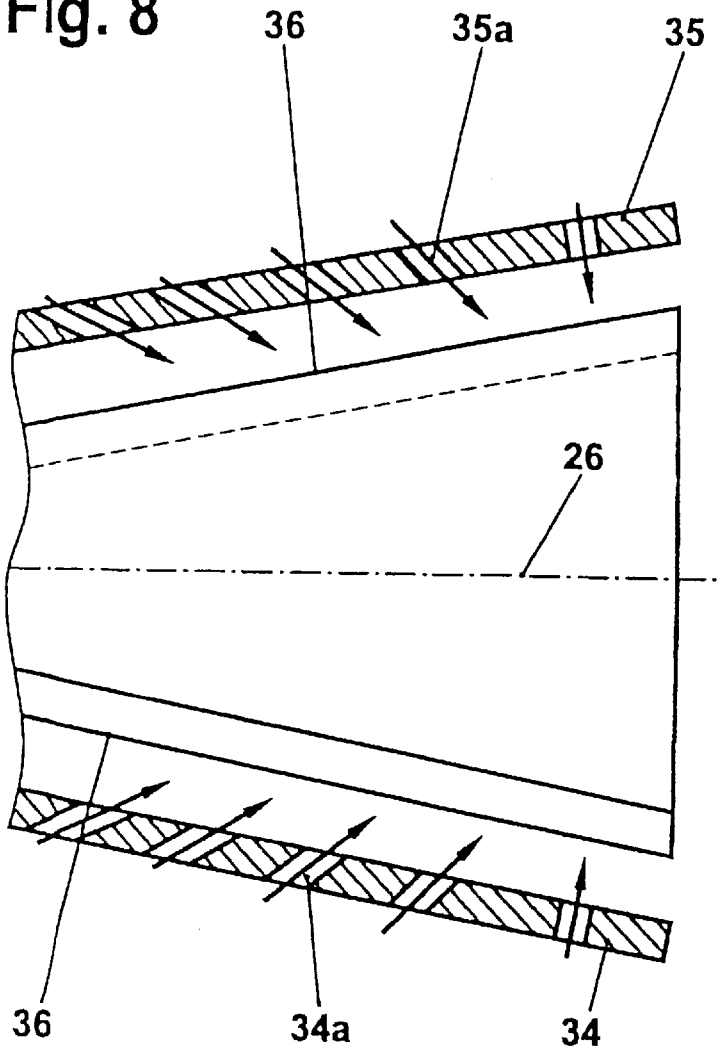
FIG. 8 shows a further configuration of the injector system in the direction of flow.

FIGS. 7 and 8 show essentially the same configuration according to FIGS. 5 and 6, the perforated plates 34, 35, together with the associated injector nozzles 34*a*, 35*a*, likewise running parallel to the inflow planes 36 of the supply ducts 27, 28 over the entire burner length. However, these inflow planes 36 run conically in relation to the burner axis 26 of the premixing burner. Here too, the variable inflow angle of the injector nozzles 34*a*, 35*a* in the direction of flow corresponds largely to the configuration according to FIGS. 5 and 6, the gradual straightening up of these injector nozzles 34*a*, 35*a* leading to a perpendicular inflow in the region of the exit of the premixing burner primarily in relation to the inflow plane 36 of the respective supply duct.

Obviously, numerous modifications and variations of the present invention are possible in light of the above teachings. It is therefore to be understood that, within the scope of the appended claims, the invention may be practised otherwise than as specifically described herein.

What is claimed as new and desired to be secured by Letters Patent of the United States is:

1. A boiler plant for heat generation comprising:

a combustion chamber;

a premix burner, said premix burner acting on the upstream side of the boiler and configured and arranged for operation on liquid and/or gaseous fuel, said premix burner including at least one region where combustion air is introduced and means for inducing aerodynamic flame stabilization by vortex breakdown and the formation of an inner backflow zone within said combustion chamber, said means positioned adjacent to said region where combustion air is introduced into said premix burner;

at least one diaphragm-shaped means within said combustion chamber dividing said combustion chamber into an upstream part and a downstream part, said diaphragm-shaped means forming a downstream limitation of said inner backflow zone within the upstream part, said diaphragm-shaped means forming outer backflow zones fed by recirculating flue gases; and wherein said inner backflow zone and said outer backflow zones are locally separated from each other.

2. The boiler plant as claimed in claim 1, wherein the diaphragm-shaped means is an annular disk.

3. The boiler plant as claimed in claim 1, wherein said burner comprises at least two hollow conical part bodies nested one in the other in the direction of flow, wherein the center axes of these part bodies are offset to one another in such a way that adjacent walls of the part bodies form tangential air inlet ducts for combustion air, and wherein the burner can be operated by means of at least one fuel nozzle.

4. The boiler plant as claimed in claim 3, wherein said fuel nozzle is arranged on an upstream side of the burner substituted and on the burner axis.

5. The boiler plant as claimed in claim 3, further comprising a plurality of fuel nozzles located at a distance from one another arranged in the region of the tangential air inlet ducts along the longitudinal extent of the burner.

6. The boiler plant as claimed in claim 3, wherein said part bodies together form a conical cavity having a throughflow cross section, which cross section increases uniformly in the direction of flow.

7. The boiler plant as claimed in claim 3, wherein said part bodies together form a conical cavity having a throughflow cross section selected from the group consisting of a diffuser, a diffuser-like shape, a confuser and a confuser-like shape.

8. The boiler plant as claimed in claim 3, wherein said part bodies are spirally nested one in the other.

9. The boiler plant as claimed in claim 3, further comprising supply ducts extending substantially in a radial direction in relation to said air inlet, said supply ducts each having at least one injector system for providing combustion air comprising fresh air and of reacted gases.

10. The boiler plant as claimed in claim 9, wherein each of said injector systems further comprises perforated plates running substantally perpendicular to an axis of said supply ducts, wherein said perforated plates comprise injector nozzles in the region of an entrance of said supply ducts, and wherein the inflow angle of the injector nozzles can be varied at right angles or continuously in relation to the burner axis in the axial direction of the burner.

11. The boiler plant as claimed in claim 10, wherein the throughflow plane of said injector nozzles forms an acute angle in the region of the head stage of the burner, and wherein said acute angle gradually increases in the axial direction of said perforated plates until said angle is substantially perpendicular to airplane through an entrance of said supply ducts and/or to the burner axis.

* * * * *